United States Patent [19]

Hibino et al.

[11] Patent Number: 4,505,130

[45] Date of Patent: Mar. 19, 1985

[54] ICE MAKING MACHINE

[75] Inventors: Takashi Hibino; Nobutaka Naruse, both of Toyoake; Kazuhiro Yoshida, Nagoya, all of Japan

[73] Assignee: Hoshizaki Electric Co., Ltd., Toyoake, Japan

[21] Appl. No.: 589,667

[22] Filed: Mar. 13, 1984

[51] Int. Cl.[3] ..... F25C 1/12

[52] U.S. Cl. ..... 62/347; 62/348

[58] Field of Search ..... 62/347, 348, 74; 210/498

[56] References Cited

U.S. PATENT DOCUMENTS

| | | | |
|---|---|---|---|
| 2,657,547 | 11/1953 | Heuser | 62/347 X |
| 2,674,858 | 4/1954 | Magnuson et al. | 62/348 X |
| 2,836,038 | 5/1958 | Morgan | 62/348 X |
| 3,254,501 | 6/1966 | Brysselbout | 62/347 X |
| 3,407,621 | 10/1968 | Dedricks et al. | 62/188 |
| 3,847,813 | 11/1974 | Castelli | 210/498 X |
| 3,913,349 | 10/1975 | Johnson | 62/348 X |
| 4,107,943 | 8/1978 | Ohling | 62/347 X |
| 4,412,429 | 11/1983 | Kohl | 62/347 |

FOREIGN PATENT DOCUMENTS

| | | | |
|---|---|---|---|
| 55-79766 | 6/1980 | Japan | 62/347 |

*Primary Examiner*—William E. Tapolcai

*Attorney, Agent, or Firm*—Wenderoth, Lind & Ponack

[57] ABSTRACT

The ice making machine constructed in accordance with the invention has an ice making mold with a plurality of ice making cells opened at the bottom, a water tank, water spray nozzles adapted for spraying the water contained in the water tank towards said ice making cells, an ice stocker adapted for storage of ice cubes formed in and harvested from said ice making cells, and an inclined plate having water spray openings and recovery openings and mounted between said ice making mold and the water spray nozzles.

The inclined plate comprises a corrugated upper section, a similarly corrugated lower section and a transition section having a flat surface and interconnecting said upper and lower sections. The recesses and projections of the upper section are aligned respectively with projections and recesses of said lower section in the direction in which the water and ice cubes are moved on the inclined plate. The lowermost points of the recesses of the upper section are connected to and are at the same height level as the uppermost points of the associated projections of the lower section.

9 Claims, 11 Drawing Figures

ICE MAKING MACHINE

BACKGROUND OF THE INVENTION

This invention relates to an ice making machine and, more particularly, to a so-called open-cell type ice making machine with its ice making mold provided with a plurality of ice-making cells each of which is opened at the bottom and closed at the top.

The ice making machine of this type is shown by way of example in FIG. 1 and comprised of an ice making mold 1, a water tank 11 disposed therebelow, an ice stocker 12 disposed close to said water tank 11, and an inclined plate 7 positioned intermediate said ice making mold 1 and the water tank 11 and having a downward gradient towards ice stocker 12. The ice making mold 1 has a soup plate-like member 5 having a large number of through-holes, ice making cups 2 engaged in inverted position in said through-holes, said cups defining ice making cells closed at the top and opened at the bottom, and an evaporator 3 in the form of a heat exchange tube in heat exchange relation with ice making cups 2. The inclined plate 7 has water spray openings 8 to permit water to be sprayed into said ice making cells 4 from a plurality of spray nozzles 10*a* of a water spray tube 10 mounted below inclined plate 7 (only one spray nozzle 10*a* being shown in the drawing). The plate 7 also has water recovery openings 9 to permit recovery into water tank 11 of return water that has been sprayed into said ice making cells but descended unfrozen onto the inclined plate 7. Water is supplied to the water spray tube 10 by a water circulating pump 11*a* associated with water tank 11.

In such ice making machine, prior to starting ice making cycle of operation, a water valve WV provided to a water supply tube 6 is opened for supplying water to a cavity 5*b* of the soup plate-like member 5. The water thus supplied descends onto inclined plate 7 through an opening 5*a* in the bottom of the soup plate-like member 5 to descende further therefrom into water tank 11 through recovery openings 9 of the inclined plate 7. When the water in water tank 11 has attained a predetermined level, water valve WV is closed for driving water circulating pump 11*a* and a refrigerating system including said evaporator 3 into operation. This initiates the ice making operation so that the ice making cups 2 are cooled by the evaporator 3, while the ice making water is sprayed from spray nozzles 10*a* into the thus cooled ice making cups 2. Thus, an ice cube is grown gradually in each ice making cell 4. The unfrozen water descends onto inclined plate 7 as mentioned hereinabove.

When the ice cube has grown to a predetermined size, such state is sensed by a known ice making sensor which then causes cessation of the ice making operation and start of the ice harvesting operation. In such ice havesting operation, water valve WV is again opened to supply water to cavity 5*b* of soup plate-like member 5, while simultaneously a hot gas valve, not shown, of the refrigerating system is opened for supplying a hot gas into evaporator 3. The result is that ice cubes formed in the ice making cells 4 are removed from ice making cups 2 and descend onto inclined plate 7 to slide down thereon to be stocked in ice stocker 12.

The inclined plate 7 is a flat thin plate in which are punched rectangular openings 9 in staggered relation as shown in FIG. 1A. Hence so far as ice cubes are concerned, they tend to be caught in the openings 9 in the inclined plate 7. When this occurs, the cube ice 4*a* thus caught in the openings 9 is melted gradually to be seated firmly in the openings 9 (FIG. 1B) to interfere with travel of the following ice cubes sliding down towards ice stocker 12. So far as return water is concerned, return water flowing through a ligament zone 7*a* between adjoining openings 9 tends to bypass the downstream side opening 9*a* and be deviated into two streams as shown at a, b in FIG. 1A or to skip over the opening 9*a* as shown at c in FIG. 1A. The result is that return water flowing further down tends to be spurted out of water tank 11. In addition, return water will flow down through water spray opening 8 to be impinged on a jet opening of each spray nozzle 10*a*, thus disturbing the flow of spray water from the jet opening and abstructing smooth water spraying to the ice making cells 4 to make it difficult to procure ice cubes of uniform size.

Hence, there is a strong demand for an ice making machine which avoids the aforementioned deficiency and provides an ice making machine whereby return water on the inclined plate may be positively recovered into water tank, the ice cubes may slide down smoothly on the inclined plate and return water does not disturb the flow of spray water from water spray nozzle.

SUMMARY OF THE INVENTION

The ice making machine constructed in accordance with the teaching of the present invention comprises an ice making mold having a plurality of inverted ice making cups each defining an ice making cell closed at the top and opened at the bottom, a water tank disposed below said ice making mold, an ice stocker disposed adjacent to said water tank, and an inclined plate mounted between said ice making mold and said water tank with a downward gradient towards said ice stocker. The inclined plate has a plurality of water spray openings through which water contained in the water tank can be sprayed towards ice making cells by a water circulating pump through a plurality of spray nozzles positioned on the lower side of the inclined plate. The inclined plate also has a plurality of recovery openings through which water falling on the inclined plate is recovered and restored to the water tank.

According to the present invention, the inclined plate is formed of a corrugated upper section onto which return water from the ice making mold may fall directly and a similarly corrugated lower section adapted for receiving return water flowing down on said upper section, with the lower end of said upper section and the upper end of said lower section being connected together by a flat transition section. The upper and lower sections are undulated in a direction substantially at right angles to the direction in which return water flows down on the plate, with respective projections and recesses of the undulated upper and lower sections extending in the direction in which return water falls down along the plate. The upper and lower sections are phase shifted so that projections and recesses of the upper section are aligned respectively with recesses and projections of the lower section. The lowermost points of the recesses of the upper section are at the same level as or at a higher level than the uppermost points of the projections of the lower section. Hence, return water is caused to flow over a step when flowing down through the transition section between the upper and lower sections. The water spray openings are provided at predetermined positions at the projections of the upper section, whereas the recovery openings are provided at predetermined positions at the recesses of the lower section.

According to preferred embodiments of the invention, the transition section is inclined towards the lower section with an acuter downward slope than the inclined plate, and a flexible curtain is provided so that its lower end is contacted with the flat upper surface of the transition section. The recovery opening is of a narrow width and a broad width respectively at the upstream and downstream sides relative to the direction in which return water flows down along the inclined plate.

BRIEF DESCRIPTION OF THE DRAWINGS

The invention will now be described, by way of example only, with reference to the accompanying drawings, in which.

DESCRIPTION OF THE PREFERRED EMBODIMENTS

Figure 1:
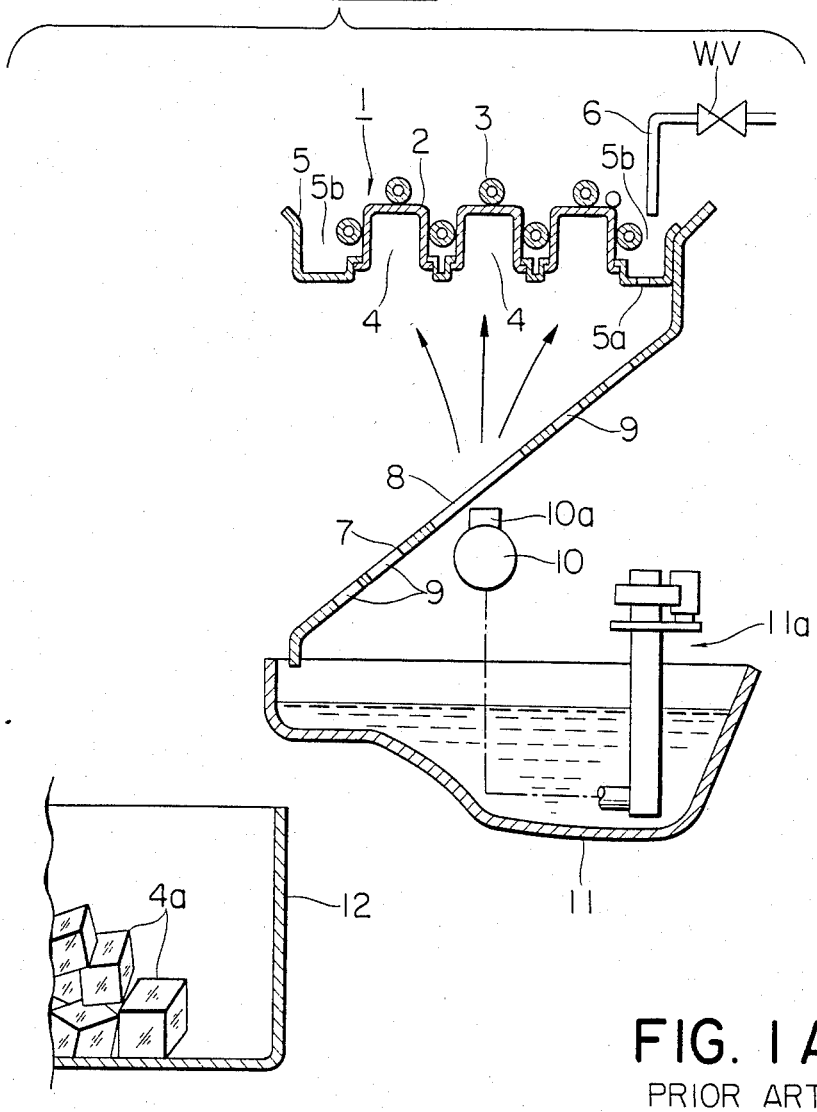
FIG. 1 PRIOR ART
FIG. 1 is a diagrammatic sectional view showing substantial parts of the conventional open-cell type ice making machine provided with an inclined plate.
Figure 1A:
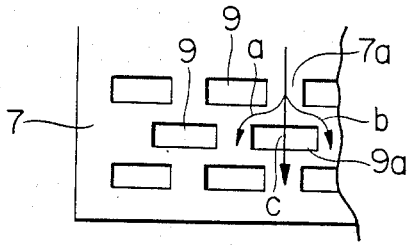
FIG. 1A PRIOR ART
FIG. 1A is a plan view showing a portion of the inclined plate shown in FIG. 1.
Figure 1B:
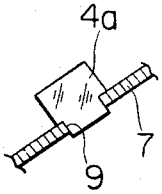
FIG. 1B PRIOR ART
FIG. 1B shows an ice cube caught in a recovery opening in the inclined plate shown in FIG. 1.

The present invention is hereinafter described by referring to the accompanying drawings, in which similar or corresponding parts are designated by the same reference numerals.

Figure 2:
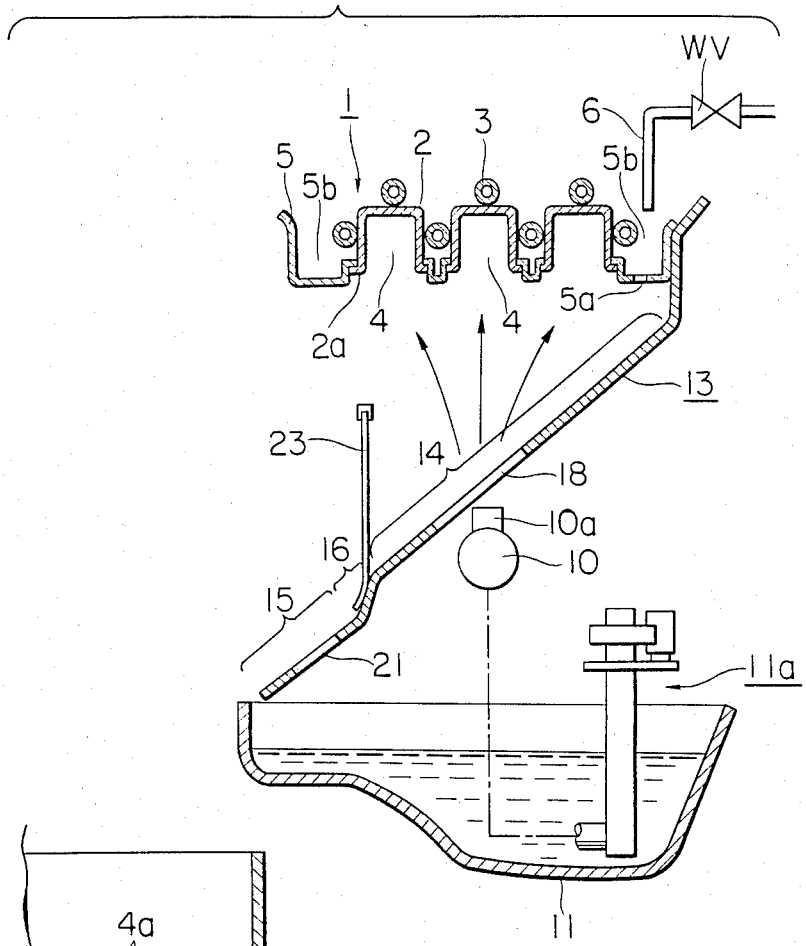
FIG. 2 is a diagrammatic sectional view showing substantial parts of the open cell type ice making machine according to the present invention.

FIG. 2 shows an embodiment of the ice making machine of the present invention which may be considered to be substantially same as the prior-art ice making machine shown in FIG. 1, except water-ice separating means or the structure of the inclined plate 13 and the provision of a curtain 23. Therefore, the parts similar to those shown in FIG. 1 are not further described herein for simplicity.

Figure 3:
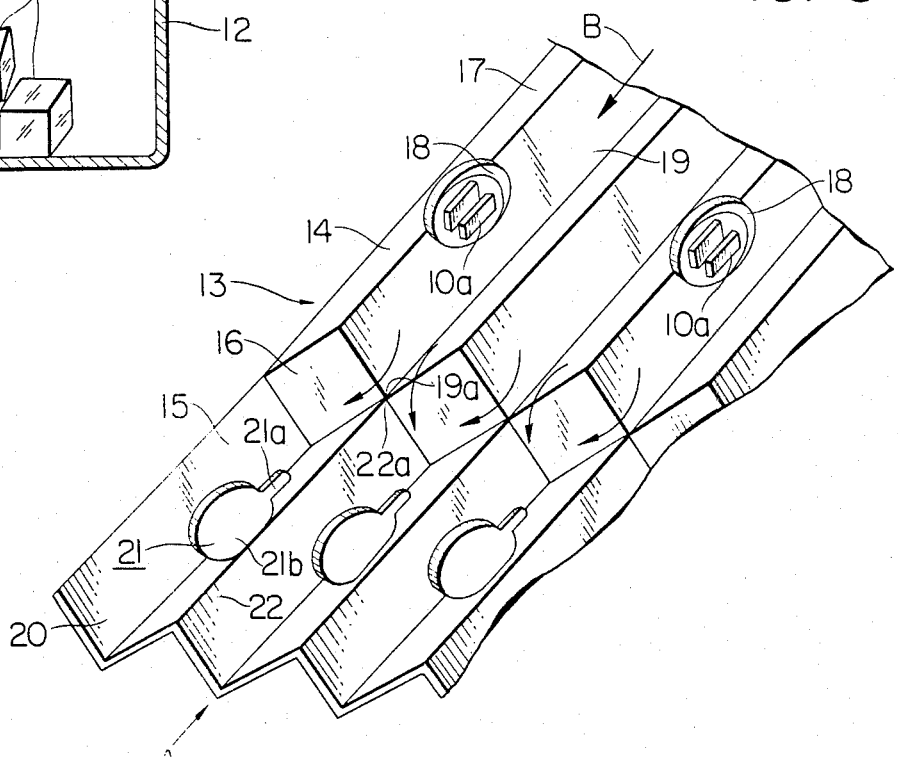
FIG. 3 is a perspective view showing a part of the inclined plate shown in FIG. 2.
Figure 4:
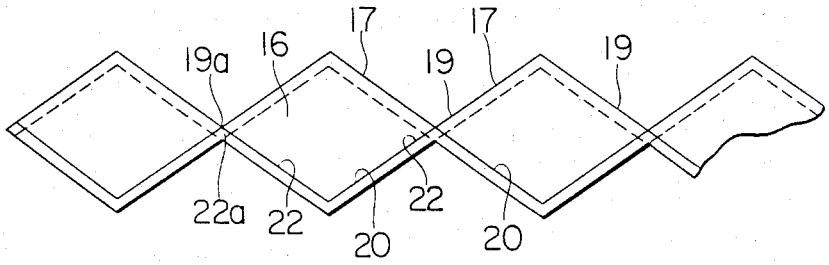
FIG. 4 is a side elevation of the inclined plate, looking in the direction of the arrow A in FIG. 3.

Referring to FIG. 2, the inclined plate 13 is of generally one-piece integral formation comprising an upper portion 14 adapted for directly receiving water and ice cubes 4*a* descending from ice making mold 1, a lower portion 15 adapted for receiving water and ice cubes 4*a* from upper portion 14 and a transition section 16 presenting a flat surface and interconnecting the upper and lower sections 14, 15. As shown in FIGS. 3 and 4, the upper section 14 and the lower section 15 are formed with projections 17, 22 and recesses 19, 20 undulated substantially transversely of the flowing direction of ice and water on the inclined plate 13 shown diagrammatically by the arrow mark B in FIG. 3. The upper and lower portions 14, 15 are phase shifted to each other so that the projections 17 and recesses 19 of the upper section 14 are aligned respectively with the recesses 20 and projections 22 of the lower section 15. The lowermost point 19*a* of the recess 19 of the upper section 14 is at the same height level as the uppermost point 22*a* of the projection 22 of the lower section 15 so that return water is caused to flow over steps at the transition section 16 between the upper and lower portions 14, 15 of the inclined plate 13.

In the present embodiment, the transition section 16 comprises a plurality of diamond-shaped zones, that is, the recess of the upper section and the associated projection of the lower section are directly connected to each other at the respective lower end 19*a* and upper end 22*a*. Although not shown, the lower end 19*a* may be disposed above the associated upper end 22*a*. In addition, although the transition section 16 is sloped down at an acuter angle than the upper section 14 or the lower section 15 towards the downstream side relative to the flow direction of return water, as shown in FIG. 2, the section 16 may also be extended down vertically. Moreover, the upper and lower sections 14, 15 need not be inclined at the same angle.

Figure 5:
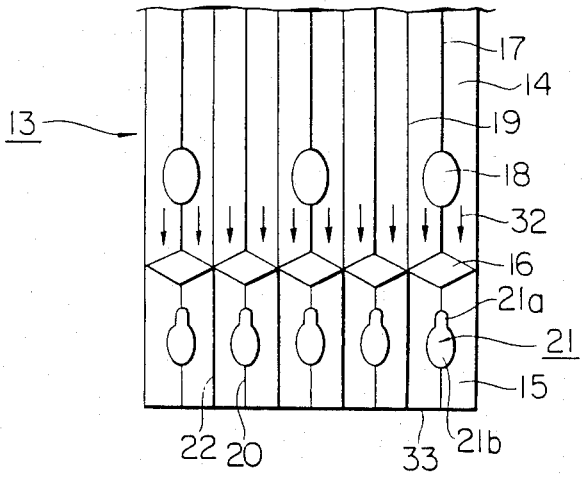
FIG. 5 is a plan view showing a part of the inclined plate shown in FIG. 2.

As seen from FIGS. 3 and 5, every other projection 17 of the upper section 14 is provided with a water spray opening 18 in register with water spray nozzle 10*a*. In the present embodiment, three water spray openings 18 (see FIG. 5) are provided in register with three water spray nozzles 10*a* each of which operates to simultaneously spray water to three ice making cells 4 (FIG. 2) so that nine ice cubes may be produced per each ice making operation. However, the ice making machine may have any capacity as desired.

Figure 6A:
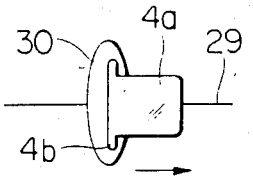
FIGS. 6A, 6B show different examples of the recovery openings provided to the inclined plate.
Figure 6B:
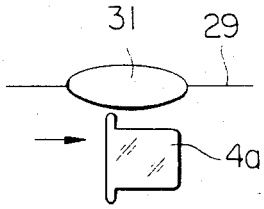
Figure 7A:
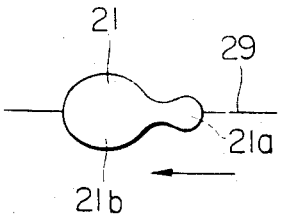
FIGS. 7A, 7B show different examples of recovery openings provided to the inclined plate in accordance with the present invention.
Figure 7B:
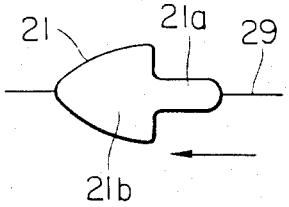

As shown in FIGS. 2, 3 and 5, the respective recesses 20 of the lower section 15 are provided with recovery openings 21 at preselected positions for collecting return water into the water tank 11 as it flows down from the upper portion 14. In general, the wider the opening area of the recovery opening 21, the better the water recovery efficiency, if only the water recovery efficiency is to be considered. However, too wide an opening area of the recovery opening tends to cause the ice cube to be caught in the recovery opening. Above all, when the ice cube formed in the ice making cup 2 has grown to a flange 2*a* of the cup 2, a corresponding flange is formed on the ice cube. When the recovery opening in this case is elongated in a direction at a right angle to the deepest part 29 of the recess as shown in FIG. 6A, the ice cube 4*a* sliding down in the direction of the arrow mark tends to be trapped at its flange 4*a* in the elongated opening 30. If, on the contrary, a recovery opening 31 (FIG. 6B) is elongated in the direction of the deepest part 29, the ice cube does not tend to be caught in the opening, however, the return water recovery efficiency is lowered. The recovery opening in the inclined plate 13 of the present invention is designed to make the best use of the elongated openings 30, 31 and to eliminate their deficiency. Thus, as seen from FIGS. 3 and 5, the recovery opening is in the form of a ping-pong paddle having an upstream side narrow zone 21*a* and a downstream side broad zone 21*b* in the sliding direction of the ice cube, the narrow zone 21*a* allowing the ice cubes to slide smoothly and the broad zone 21*b* assuring an efficient recovery of return water, said broad zone being naturally lesser in size than the ice cube. The recovery opening 21 may be in the form of a figure eight as shown in FIG. 7A or in the form of an arrow head as shown in FIG. 7B. The recovery opening may be narrowed partially in which case the reduction in strength of the inclined plate may be prevented to some measure as compared to the case in which the opening consists only of the broad zone.

Referring again to FIG. 2, the curtain 23 may be a strip of thin transparent flexible material such as polyethylene film and has its upper end carried by some stationary part, not shown, of the ice making machine and its lower end slightly bent in conformity with and contacting the flat surface of the transition section 16. The function of the curtain 23 is to prevent spurting and realize a high efficiency recovery of return water.

The operation of the ice making machine is hereinafter described by referring to the drawings.

Referring to FIGS. 2, 3 and 5, water valve WV is first opened in order to allow ice making water to be filled to a predetermined level in water tank 11. Water is supplied into cavity 5*b* of the soup plate-like member 5 from water supply tube 6 to fall on the upper portion 14 of the inclined plate 13 through opening 5*a* in the bottom of the soup plate-like member 5. The falling water (return water) will flow down the recesses 19 of the upper portion 14 to the transition zone 16 where it is slightly deenergized by striking on the lower end of curtain 23 and falls on associated projections 22 of the lower section 15. The return water impinging on the projections 22 is thereby divided into left-hand and right-hand streams which are then directed to the associated recesses 20 of the lower section and fall into water tank 11 through recovery openings 21 in the recesses 20. When water has been filled to a predetermined level in water tank 11, water valve WV is closed for starting the ice making operation. Since the curtain 23 has a surface contact with the transition zone 16, the risk of the curtain being opened or deflected under the force of the return water is minimized. During the ice making operation, refrigerant is supplied to evaporator 3 for cooling the ice making cups 2. Water contained in water tank 11 is supplied to spray nozzles 10*a* of the water spray tube 10 by the operation of the water circulating pump 11*a*. Thus, a part of sprayed water is frozen and affixed to the inner surface of each ice making cup 2 for forming an ice layer which then grows in size gradually to an ice cube. The water that has not become frozen into ice descends from ice making cups 2 onto the upper section 14 of the inclined plate 13. Since the spray openings 18 are formed in the projections 17 of the upper section 14 and return water falling on upper section 14 will flow down the recesses 19 of the section 14, there is no risk of return water disturbing the flow of spray water from water spray nozzle 10*a*. The return water flows down to transition zone 16 where it falls on the top of the projections 22 of the lower section 15 while being deactivated by the lower end of curtain 23. The return water is then divided by the projections 22 into left-hand and right-hand streams which are directed towards recesses 20. The water thus flowing on the recesses 20 may be recovered efficiently by recovery openings 21.

The water sprayed to ice making cups 2 but not frozen tends to be collected at flanges 2*a* (FIG. 2) of the ice making cups 2 and to fall down therefrom onto inclined plate 13. Since the sector-shaped spray water flow supplied from spray nozzles 10*a* positioned below the projections is directed towards the centerline of the ice making cups arranged in a row, water falls down concentrately onto intermediate zones between adjoining projections of the inclined plate 13. Assuming that the sections 14, 15 are not out of phase relative to each other but the recesses 19 of the upper section 14 are aligned with the recesses 20 of the lower section 15, contrary to the teaching of the present invention, the water falling down concentrately on about the mid zones 32 of the projections in FIG. 5 is scarcely changed in its direction but allowed to flow down along the slope of the inclined plate 13. It is therefore difficult to recover the totality of return water in the recovery openings. According to the present invention, however, since the recesses 19 of the upper section 14 are aligned with the projections 22 of the lower section 15, the water falling on about the mid zones 32 of the projections in FIG. 5 is changed in its direction at the transition zone 16 and directed towards the recesses 20 of the lower section 15 where it is recovered positively in the recovery openings 21.

When the ice cubes in the ice making cups 2 have reached the predetermined size and thus it is time to stop the ice making operation, such state is sensed by means well known in the art and the ice making machine is switched from ice making to ice harvesting operation.

In the ice harvesting operation, the operation of the water circulating pump 13 is stopped for stopping water spraying from water spray nozzles 10*a*. A hot gas valve, not shown, in the refrigerating system is opened for supplying a hot gas through evaporator 3. Simultaneously, water valve WV is opened for supplying ice harvesting water to the cavity 5*b* of the soup plate-like member 5. The result is that the ice making cups 2 are warmed by the hot gas and ice harvesting water. During such warming, the ice harvesting water falls down onto upper section 15 of inclined plate 13 through hole 5*a* to flow down on the recesses 19. The water thus flowing down is deenergized by curtain 23 and divided by projections 22 of lower section 15 into left-hand and right-hand streams flowing into recovery openings 21 in the recesses 21. By such warming, those portions of the ice cubes in the respective ice making cells 4 that are contacted with the associated ice making cups 2 are melted so that the cubes are detached by gravity from the ice making cups 2 and fall onto upper section 14 of inclined plate 13 to be introduced into ice stacker 12 through the transition zone 16 and the lower section 14. It should be noted that not only water spray holes 18 in the section 14 but also recovery holes 21 in the lower section 15 are sufficiently smaller than the ice cubes and hence are not obstractive to the ice cubes sliding down on the inclined plate 13. Above all, since each recovery hole 21 is comprised of the upstream side narrow portion 21*a* and the downstream side broad portion 21*b*, water can be introduced efficiently, into recovery openings 21 whereas ice cubes are not caught in but adequately passed over these recovery openings 21.

From the foregoing it may be seen that the arrangement of the present invention provides an automatic ice making machine in which return water on the inclined plate may be positively recovered into water tank and the ice cubes on the inclined plate may be conveyed smoothly along the inclined plate and into ice stacker, while the flow of spray water from spray nozzles is not disturbed by return water on the inclined plate.

What is claimed is:

1. An ice making machine comprising:

an ice making mold having a plurality of ice making cells in which to form ice cubes and each of which is closed at the top and opened at the bottom;

means mounted below said ice making mold for spraying ice making water into said ice making cells during an ice making operation;

a water tank mounted below said water spray means to store water to be supplied to said water spray means;

an ice stocker mounted in the vicinity of said water tank;

means for separating water and ice cubes from one another, said separating means comprising an inclined plate mounted intermediate said ice making mold and said water spray means with a downward gradient toward said ice stocker, said inclined plate having water spray openings to permit water to be sprayed from said water spray means towards said ice making cells and recovery openings to permit falling water from said ice making mold to be recovered in said water tank; and said inclined plate having a corrugated upper section, a corrugated lower section, each said corrugated section comprising an alternate pattern of projections and recesses generally extending in the direction of the water and ice cubes flowing down on the plate, and a transition section positioned between and interconnecting said upper and lower sections, the recesses and projections of said upper section being aligned in said direction with associated projections and recesses of said lower section, said water spray openings being formed in selected ones of said projections of said upper section and said recovery openings being formed in the totality of recesses of said lower section.

2. The ice making machine as claimed in claim 1, wherein said transition section comprises a flat plate connected at one end to the upper edge of the corrugated lower section and at the other end to the lower edge of the corrugated upper section, the lowermost points of said corrugated upper section being generally at the same height level as the uppermost points of said corrugated lower section.

3. The ice making machine as claimed in claim 2, wherein said transition section is inclined with a larger downward gradient towards said ice stocker than said upper and lower sections.

4. The ice making machine as claimed in claim 1, wherein each of said recovery openings is comprised of a narrow zone extending in said direction and a broad zone downstream of said narrow zone relative to said direction and extending in said direction from one end of said narrow zone.

5. The ice making machine as claimed in claim 4, wherein said recovery opening is in the form of a ping-pong paddle.

6. The ice making machine as claimed in claim 4, wherein said recovery opening is in the form of a figure eight.

7. The ice making machine as claimed in claim 4, wherein said recovery opening is in the form of an arrowhead.

8. The ice making machine as claimed in claim 1, further comprising a thin flexible curtain hung from the upper end so that its lower end abuts on the surface of said transition section.

9. The ice making machine as claimed in claim 8, wherein the lower edge of said curtain has a profile complementary to the corrugated form of said lower section.

* * * * *